US009546811B2

(12) United States Patent
Lee et al.

(10) Patent No.: US 9,546,811 B2
(45) Date of Patent: Jan. 17, 2017

(54) INDICATING DEVICE AND REFRIGERATOR HAVING THE SAME

(75) Inventors: Myung Ju Lee, Gwangsan-gu (KR); Young Yun, Gwangsan-gu (KR); Sung Cheol Kang, Gwangsan-gu (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1125 days.

(21) Appl. No.: 13/613,875

(22) Filed: Sep. 13, 2012

(65) Prior Publication Data

US 2013/0067937 A1 Mar. 21, 2013

(30) Foreign Application Priority Data

Sep. 19, 2011 (KR) ..... 10-2011-0094307

(51) Int. Cl.
*F25B 49/00* (2006.01)
*F25D 29/00* (2006.01)

(52) U.S. Cl.
CPC ..... *F25D 29/00* (2013.01); *F25D 2400/361* (2013.01); *F25D 2500/06* (2013.01); *F25D 2700/00* (2013.01); *F25D 2700/08* (2013.01); *F25D 2700/16* (2013.01)

(58) Field of Classification Search
CPC ..... F25D 2700/06; F25D 2700/08; F25D 2700/16; F25D 29/003; F25D 29/005; F25B 49/00
See application file for complete search history.

(56) References Cited

U.S. PATENT DOCUMENTS 4,697,429 A 10/1987 Chandler et al.
2002/0116936 A1 8/2002 Cartwright et al.
2004/0100380 A1 5/2004 Lindsay et al.
(Continued)

FOREIGN PATENT DOCUMENTS

EP 1 624 267 A2 2/2006
EP 1 624 724 A1 2/2006
(Continued)

OTHER PUBLICATIONS

European Search Report dated Aug. 11, 2015 issued in corresponding European Patent Application 12184226.4.
(Continued)

*Primary Examiner* — Frantz Jules
*Assistant Examiner* — Erik Mendoza-Wilkenfe
(74) *Attorney, Agent, or Firm* — Staas & Halsey LLP

(57) ABSTRACT

Disclosed herein is a refrigerator capable of varying a storage condition for food in accordance with a state of the food, thereby storing the food in a fresher state for a prolonged period of time. The refrigerator includes an indicating device to measure a state of food. The indicating device is provided to be portable, separately from a refrigerator body. The indicating device includes a measurement terminal, which come into contact with food, only when contact is needed. The refrigerator also includes an input unit to receive data about a state of food, a determination unit to determine a storage condition for the food, based on the input food state data, and a controller to control driving of the cooling device, based on the determined food storage condition. The indicating device includes a measurement unit to obtain food state data, and a display to display the food state data.

22 Claims, 7 Drawing Sheets

(56) References Cited

U.S. PATENT DOCUMENTS

| | | | | |
|---|---|---|---|---|
| 2004/0216472 | A1* | 11/2004 | Cho | A23B 7/10 62/126 |
| 2005/0258961 | A1 | 11/2005 | Kimball et al. | |
| 2006/0242975 | A1* | 11/2006 | Furlanetto | A23L 3/001 62/209 |
| 2006/0249029 | A1* | 11/2006 | Hahm | A23L 1/218 99/275 |
| 2006/0254432 | A1* | 11/2006 | McLemore | A47J 37/1209 99/448 |
| 2008/0048954 | A1* | 2/2008 | Lee | F25D 29/00 345/82 |
| 2008/0066485 | A1* | 3/2008 | Park | A23B 7/04 62/441 |
| 2008/0134697 | A1* | 6/2008 | Tonon | F25D 23/028 62/125 |
| 2008/0175301 | A1* | 7/2008 | Chen | G01J 5/02 374/121 |
| 2009/0096617 | A1 | 4/2009 | Purcell et al. | |
| 2010/0128753 | A1* | 5/2010 | Claypool | G01K 1/02 374/102 |

FOREIGN PATENT DOCUMENTS

| | | | |
|---|---|---|---|
| EP | 1 741 367 | A1 | 1/2007 |
| JP | 3 917413 | B2 | 5/2007 |
| KR | 10-087882 | | 1/2009 |

OTHER PUBLICATIONS

Office Action issued on Aug. 12, 2016 in corresponding European Patent Application No. 12 184 226.4.

* cited by examiner

INDICATING DEVICE AND REFRIGERATOR HAVING THE SAME

CROSS-REFERENCE TO RELATED APPLICATIONS

This application claims the benefit of Korean Patent Application No. 10-2011-0094307 filed on Sep. 19, 2011 in the Korean Intellectual Property Office, the disclosure of which is incorporated herein by reference.

BACKGROUND

1. Field

Embodiments of the present invention relate to a refrigerator having an indicating device to guide setting of a desired storage condition for food to be stored in accordance with the kind and state of the food.

2. Description of the Related Art

Generally, refrigerators include a storage chamber and a cooling device to supply cold air to the storage chamber, to store food in the storage chamber in a fresh state. In such a refrigerator, the storage chamber thereof is maintained at a certain storage temperature, to keep food therein in a fresh state.

On the other hand, there is a refrigerator, the storage temperature of which is varied in accordance with the state of food, for example, the salinity or acidity of the food, in order to store the food in a more fresh state for a prolonged period of time. Examples of such a refrigerator are disclosed in Korean Unexamined Patent Publication No. 2001-0018642, Korean Unexamined Patent Publication No. 2002-0029513 and Korean Registered Patent Publication No. 10-0878822.

In the refrigerators disclosed in the above publications, a measurement terminal is attached to a container to store food, in order to measure the state of the food. However, the measurement terminal is kept in continuous contact with the food.

Furthermore, data about the food state measured through the measurement terminal or data about the storage temperature determined based on the state data is not provided to the user. For this reason, the user may doubt whether the storage temperature is reliable.

SUMMARY

Therefore, it is an aspect of the present disclosure to provide a refrigerator in which a measurement terminal to measure the state of food stored in a storage chamber can come into contact with the food, only when contact is needed.

Another aspect of the present disclosure is to provide a refrigerator capable of enabling the user to directly measure the state of food stored in the refrigerator, to enable the refrigerator to determine a desired storage condition of the food, based on the result of the measurement, thereby ensuring reliability of the determined storage condition.

Additional aspects will be set forth in part in the description which follows and, in part, will be obvious from the description, or may be learned by practice of the invention.

In accordance with one aspect, a refrigerator includes a body having a storage chamber to store food, a cooling device to supply cold air to the storage chamber, an input unit provided at the body, to receive data about a state of the food, a determination unit provided at the body, to determine a storage condition for the food, based on food state data input through the input unit, a controller provided at the body, to control driving of the cooling device, based on the storage condition determined through the determination unit, and an indicating device provided to be portable, separately from the body, the indicating device including a measurement unit to measure the state of the food, and thus to obtain the food state data, and a display to display the food state data obtained through the measurement unit, wherein, when the food state data is manually input to the body after being obtained by the indicating device, the body determines the storage condition for the food, and the driving of the cooling device is controlled, based on the determined food storage condition.

The food state data may include at least one of a salinity of the food, an acidity of the food, a temperature of the food, and a number of bacteria present in the food.

The measurement unit of the indicating device may include at least one of a salinity measurer, an acidity measurer, a temperature measurer, and a bacteria number measurer, to obtain the food state data.

The determination unit may include a memory in which data about various food storage conditions according to data about various food states is pre-stored.

The refrigerator may further include a pocket provided at the body, to hold the indicating device.

The input unit may be able to manually receive the food state data.

The input unit may be able to receive the food state data from the indicating device through wired or wireless communication.

The indicating device may further include a communication unit for the wired or wireless communication.

The input unit and the communication unit of the indicating device may include connection terminals to come into contact with each other for electrical connection thereof, respectively.

The refrigerator may further include a kind input unit to receive data about the kind of the food, The determination unit may determine the food storage condition, based on the food state data input through the input unit and the food kind data input through the kind input unit.

The kind input unit may selectively receive the kind input data.

The determination unit may include a memory in which data about various food storage conditions according to data about various food states and data about various food kinds is pre-stored.

The food storage condition may include a food storage temperature.

In accordance with another aspect, a refrigerator includes a body having a storage chamber to store food, a cooling device to supply cold air to the storage chamber, an input unit provided at the body, to receive data about a state of the food, a determination unit provided at the body, to determine a storage condition for the food, based on food state data input through the input unit, a controller provided at the body, to control driving of the cooling device, based on the storage condition determined through the determination unit, and an indicating device provided to be portable, separately from the body, the indicating device including a measurement unit to measure the state of the food, and thus to obtain the food state data, and a communication unit to transmit the food state data obtained through the measurement unit to the input unit of the body through wired or wireless communication, wherein, when the food state data is input to the body through wired or wireless communication after being obtained by the indicating device, the body determines the storage condition for the food, and the driving of the cooling device is controlled, based on the determined food storage condition.

In accordance with another aspect, a refrigerator includes a body having a storage chamber to store food, a cooling device to supply cold air to the storage chamber, a storage condition input unit provided at the body, to receive a storage condition for the food, a controller provided at the body, to control driving of the cooling device, based on the storage condition input through the storage condition input unit, and an indicating device provided to be portable, separately from the body, the indicating device including a measurement unit to measure a state of the food, and thus to obtain data about the measured food state, a determination unit to determine the food storage condition, based on the food state data obtained through the measurement unit of the indicating device, and a display to display the food state condition determined through the measurement unit of the indicating device, wherein, when the food state data is obtained by the indicating device, the food storage condition is determined by the indicating device, and the determined food storage condition is then manually input to the body, the driving of the cooling device is controlled, based on the determined food storage condition.

The determination unit of the indicating device may include a memory in which data about various food storage conditions according to data about various food states is pre-stored.

The storage condition input unit may be able to manually receive the food storage condition.

The storage condition input unit may be able to receive the food storage condition from the indicating device through wired or wireless communication.

The indicating device may further include a communication unit for the wired or wireless communication.

The indicating device may further include a kind input unit to receive data about a kind of the food. The determination unit of the indicating device may determine the food storage condition, based on the food state data obtained through the measurement unit of the indicating device and the food kind data input through the kind input unit of the indicating device.

The kind input unit of the indicating device may selectively receive the kind input data.

The determination unit of the indicating device may include a memory in which data about various food storage conditions according to data about various food states and data about various food kinds is pre-stored.

In accordance with another aspect, a refrigerator includes a body having a storage chamber to store food, a cooling device to supply cold air to the storage chamber, a storage condition input unit provided at the body, to receive a storage condition for the food, a controller provided at the body, to control driving of the cooling device, based on the storage condition input through the storage condition input unit, and an indicating device provided to be portable, separately from the body, the indicating device including a measurement unit to measure a state of the food, and thus to obtain data about the measured food state, a determination unit to determine the food storage condition, based on the food state data obtained through the measurement unit of the indicating device, and a communication unit to transmit the food storage condition determined through the determination unit of the indicating device to the storage condition input unit of the body through wired or wireless communication, wherein, when the food state data is obtained by the indicating device, the food storage condition is determined by the indicating device, and the determined food storage condition is then input to the body through wired or wireless communication, the driving of the cooling device is controlled, based on the determined food storage condition.

In accordance with another aspect, a refrigerator includes a body having a storage chamber to store food, a cooling device to supply cold air to the storage chamber, and an indicating device provided to be portable, separately from the body, the indicating device including a measurement unit to measure a state of the food, and thus to obtain data about the measured food state, wherein the food storage condition is determined, based on the obtained food state data, and driving of the cooling device is controlled, based on the determined food storage condition.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Hereinafter, embodiments of the present invention will be described with reference to the accompanying drawings.

Figure 1:
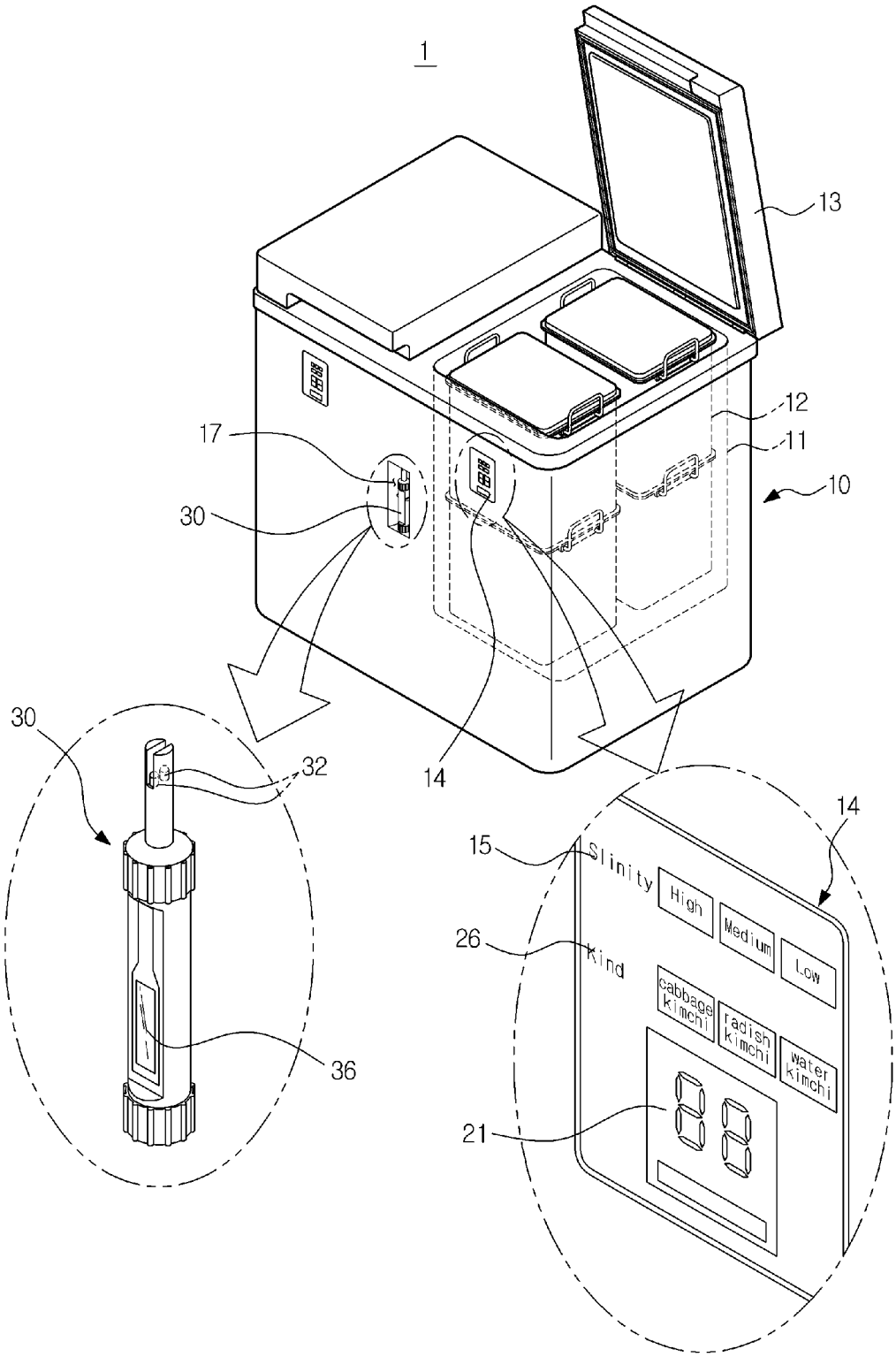
FIG. 1 is a perspective view illustrating outer appearances of a refrigerator according to an exemplary embodiment of the present invention and an indicating device provided at the refrigerator in accordance with an exemplary embodiment of the present invention.
Figure 3:
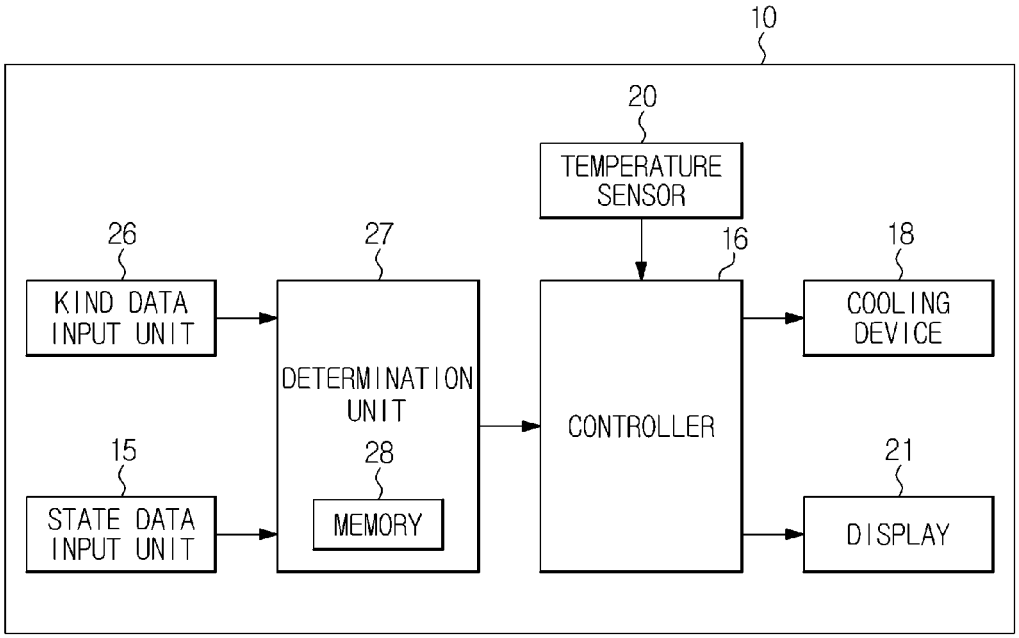
FIG. 3 is a block diagram for explaining a method for controlling the refrigerator according to the embodiment of FIG. 1.
Figure 3:
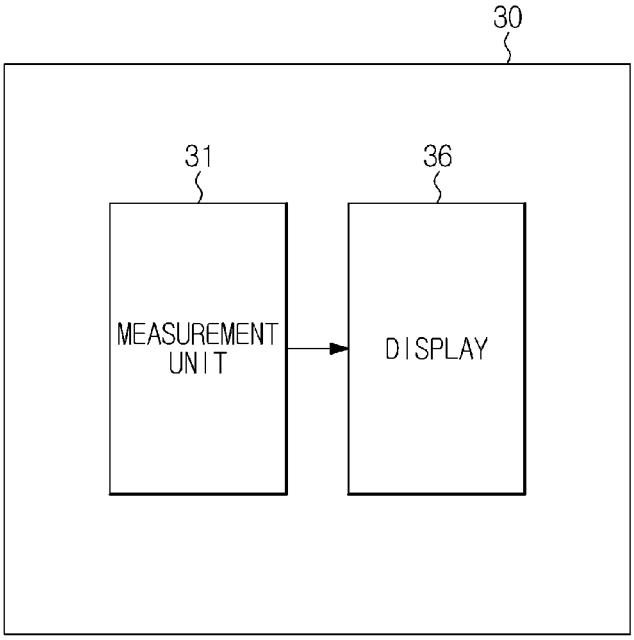

FIG. 1 is a perspective view illustrating outer appearances of a refrigerator according to an exemplary embodiment of the present invention and an indicating device provided at the refrigerator in accordance with an exemplary embodiment of the present invention. FIG. 3 is a block diagram for explaining a method for controlling the refrigerator according to the illustrated embodiment of the present invention.

Referring to FIGS. 1 and 3, the refrigerator according to the illustrated embodiment of the present invention, which is designated by reference numeral "1", includes a body 10 having a storage chamber 11, and an indicating device 30 provided separately from the body 10.

The storage chamber 11 is opened at a top side thereof to receive storage containers 12 to store food. The opened top side of the storage chamber 11 may be closed by a door 13 pivotally coupled to the body 10 by a hinge. The body 10 may have at least one storage chamber 11. However, the following description will be given in conjunction with the case in which one storage chamber 11 is provided, for simplicity of description. In the refrigerator 1 according to the illustrated embodiment of the present invention, it may be possible to maximally reduce outward discharge of cold air from the storage chamber 11 occurring during the procedure of opening and closing the door 13 in that the cold air in the storage chamber 11 sinks downwardly.

Of course, the technical idea of the present disclosure may also be applied to an upright refrigerator in which a storage chamber is opened at a front side thereof, without being limited to a refrigerator in which a storage chamber is opened at a top side thereof, as in the above-described refrigerator. The technical idea of the present disclosure may also be applied to an appliance which is used to store consumable goods.

The storage containers 12 to store food may be received in the storage chamber 11. For example, food such as kimchi, vegetables or fish may be stored in each storage container 12. At least one storage container 12 may be received in the storage chamber 11. The storage containers 12 may have the same size or different sizes.

Each storage container 12 is opened at a top side thereof to receive food, and may include a lid to cover the opened top side. Two or more storage containers 12 may be stacked in one storage chamber 11.

The refrigerator 1 may include a cooling device 18 (FIG. 3) to supply cold air to the storage chamber 11. The cooling device may include a compressor, a condenser, an evaporator, an expansion valve, a blowing fan, a cold air duct, and a damper. The refrigerator 1 may also include a heater (not shown) to apply heat to food stored in the storage chamber 11, and thus to mature the food, and a temperature sensor 20 (FIG. 3) to sense the temperature of the storage chamber 11.

Meanwhile, the refrigerator 1 may change a food storage condition including storage temperature, etc. in accordance with the kind and state of food stored in the storage chamber 11. As shown in FIG. 3, the body 10 may include a kind data input unit 26 to receive data about the kind of food, a state data input unit 15 to receive data about the state of food, a determination unit 27 to determine a desired food storage condition, and a controller 16 to control driving of the cooling device 18 in accordance with the determined food storage condition.

The kind data input unit 26 directly receives the food kind data from the user. In this case, the kind of food may be divided, for example, into kimchi, vegetables, fish, etc. Each divided food kind may be sub-divided in accordance with the materials of food and the amounts of spices added to food. For example, kimchi may be sub-divided into cabbage kimchi, radish kimchi, water kimchi, etc.

The kind data input unit 26 may include a plurality of selection buttons respectively corresponding to given food kinds, to enable the user to input a selected one of the given food kinds. An example of the selection buttons of the kind data input unit 26 is illustrated in FIG. 1.

In the example of FIG. 1, selection buttons to enable selection of cabbage kimchi, radish kimchi, and water kimchi are provided. Of course, this is merely an example. An additional selection button to select another kind of food may be provided. Also, at least one of the selection buttons to select cabbage kimchi, radish kimchi, and water kimchi may be dispensed with.

The state data input unit 15 is adapted to receive state data of food. The food state data may include at least one of the salinity, acidity, temperature of food, and the number of bacteria present in food.

The state data input unit 15 may include a plurality of selection buttons for each of the food state items. An example of the selection buttons of the state data input unit 15 is illustrated in FIG. 1.

FIG. 1 illustrates selection buttons for one of the food state items, for example, salinity. The selection buttons shown in FIG. 1 correspond to different salinity levels, namely, high salinity, medium salinity, and low salinity, respectively.

The user may directly input food state data in a manual manner through one of the selection buttons. Of course, the indicating device 30, which is included in a refrigerator according to another embodiment of the present invention, may be provided with an indicating device communication unit 38 to communicate with the state data input unit 15, and thus to transmit food state data in a wired or wireless manner.

The determination unit 27 determines a desired food storage condition such as a desired food storage temperature, based on the kind data of food input through the kind data input unit 26 and the state data of food input through the state data input unit 15. The food storage temperature means a temperature capable of allowing corresponding food to be stored in a fresh state for a prolonged period of time without freezing.

The food storage temperature may be varied in accordance with the state of food and the kind of food. For example, when the salinity of food is high, the freezing temperature of the food is low. On the other hand, when the salinity of food is low, the freezing temperature of the food is high. Accordingly, when the salinity of food is high, the storage temperature of the food is low, whereas, when the salinity of food is low, the storage temperature of the food is high.

The freezing temperature may be varied in accordance with the kind of food, even when the salinity of food is constant. For example, cabbage kimchi exhibits a lower freezing temperature than radish kimchi, and radish kimchi exhibits a lower freezing temperature than water kimchi. Accordingly, even when cabbage kimchi, radish kimchi, and water kimchi have the same salinity, the storage temperature for the cabbage kimchi is lower than that of the radish kimchi, and the storage temperature for the radish kimchi is lower than that of water kimchi.

The food storage condition such as food storage temperature may be experimentally determined, taking into consideration both food kind and food state. Accordingly, the food storage condition may be determined in various manners. For example, the food storage condition such as food storage temperature may be scaled by a plurality of notches respectively exhibiting different ranges, for convenience. For example, the food storage temperature may be scaled by a plurality of notches corresponding to "high", "medium", and "low" temperature ranges.

The determination unit 27 includes a memory 28 in which various food storage conditions according to food states and food kinds set in the above-described manner are pre-stored. The determination unit 27 may search the memory 28, to determine a food storage condition according to the food kind data input through the kind data input unit 26 and the food state data input through the state data input unit 15.

The controller 16 controls driving of the cooling device 18 in accordance with the food storage condition determined through the determination unit 27. Furthermore, the controller 16 may control driving of the heater (not shown), if necessary. The controller 16 receives data about the current temperature of the storage chamber 11 from the temperature sensor 20, which measures the temperature of the storage chamber 11. The controller 16 then compares the current temperature with a food storage temperature determined through the determination unit 27, to drive the cooling device 18 or to stop driving of the cooling device 18.

The controller 16 may control a display 21, to display the food kind data input through the kind data input unit 26, the food state data input through the state data input unit 15, food storage condition data determined through the determination unit 27, and other data. Meanwhile, the controller 16 may be configured to include the determination unit 27.

The indicating device 30 is adapted to measure the state of food stored in the storage container 12, and thus to obtain food state data. The indicating device 20 is provided to be portable, separately from the body 10 and storage container 12.

As shown in FIG. 3, the indicating device 30 may include a measurement unit 31 to measure the state of food, and thus to obtain data about the measured food state, and a display 36 to display the food state data obtained from the measurement unit 31.

The measurement unit 31 of the indicating device 30 may include at least one of measurers to measure various states of food, for example, salinity, acidity, temperature, and bacteria number present in food.

Each measurer may include a measurement terminal to measure a state of food. FIG. 1 illustrates a salinity measurement terminal which includes, for example, a pair of electrodes 32. The salinity of food may be measured using a principle that electrical conductivity is varied in accordance with the ion concentration of food.

That is, the salinity of food may be measured or calculated by applying a voltage to the salinity measurement electrodes 32 under the condition in which the salinity measurement electrodes 32 contact food, and then measuring the amount of current flowing through the salinity measurement electrodes 32.

The display 36 of the indicating device 30 displays data about various states of food measured by the measurement unit 31. The user may identify the state data displayed through the display 36. The user may also input the identified state data to the state data input unit 15.

In accordance with the above-described configuration, the refrigerator may vary the food storage condition in accordance with the state of food and the kind of food. Thus, it may be possible to store food in a fresher state for a prolonged period of time. Also, since the indicating device is separate from the body 10, it may contact food only when contact is required.

In addition, there may be a procedure in which the user directly measures the state of food using the indicating device 30, and thus to obtain data about the measured food state. Accordingly, the food storage condition of the refrigerator 1 may be more reliable.

Figure 2:
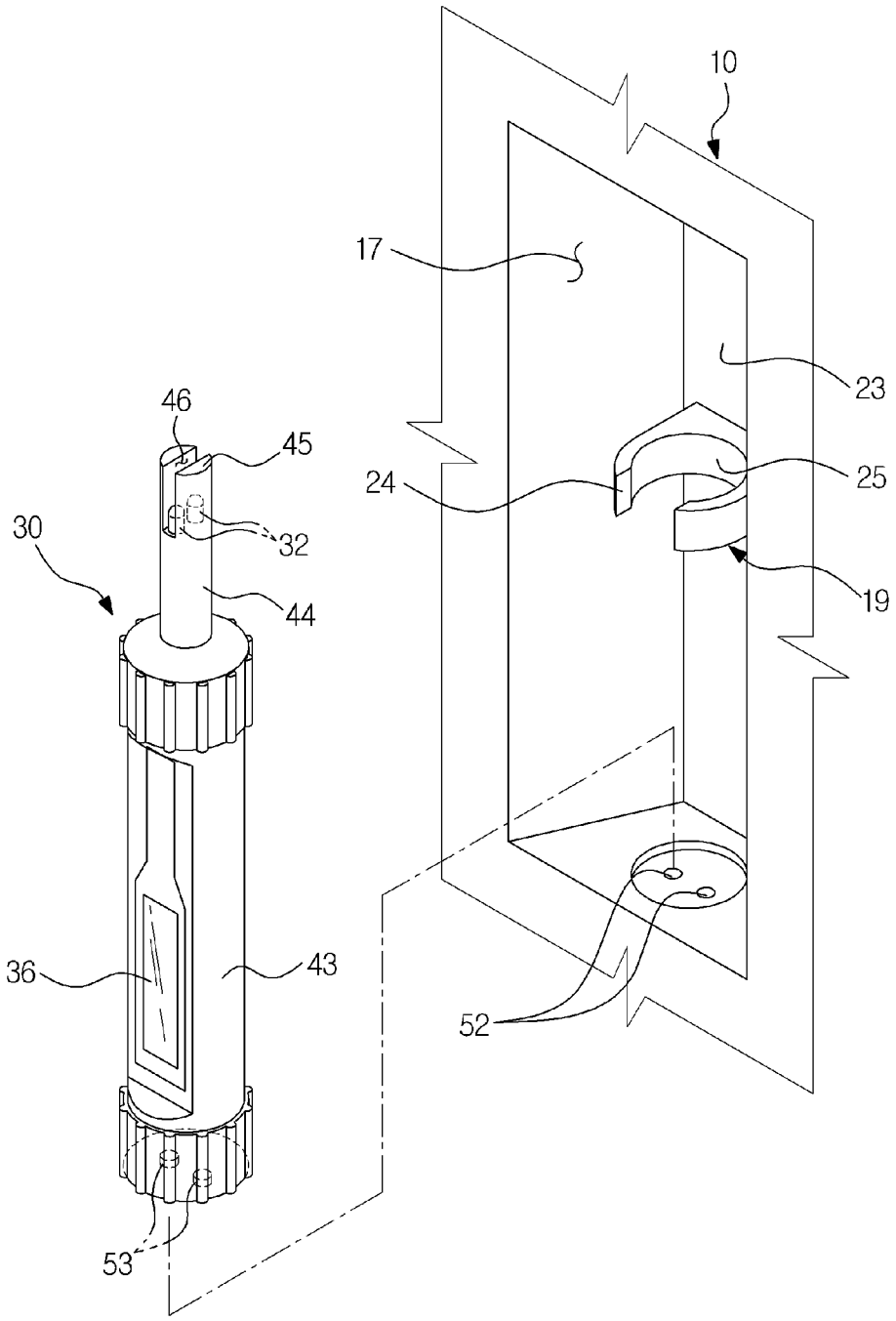
FIG. 2 is an enlarged view illustrating an indicating device of the refrigerator according to another embodiment of the present invention and a pocket for the indicating device.

FIG. 2 is an enlarged view illustrating an indicating device of the refrigerator according to another embodiment of the present invention and a pocket for the indicating device. The indicating device 30 according to the embodiment of FIG. 1 has largely the same configuration as the indicating device 30 according to the embodiment of FIG. 2. Accordingly, the refrigerator 1 according to the embodiment of FIG. 1 and the indicating device thereof will be further described with reference to FIGS. 1 and 2.

The indicating device 30 has an outer appearance having an elongated cylindrical shape. The indicating device 30 may include a body 43 and a probe 44. The probe 44 may include the measurement electrodes 32. The body 43 may include the display 36.

A pair of spaced protrusions 45 is protruded from an end of the probe 44. An opening 46 is defined between the protrusions 45. The measurement electrodes 32 may be arranged such that a portion of each measurement electrode 32 is exposed to the opening 46. In accordance with such a structure, it may be possible to prevent the measurement electrodes 32 from excessively contacting food during measurement of food state. Thus, it may be possible to prevent the measurement electrodes 32 from being damaged.

A pocket 17 may be provided at an outer wall of the body 10 to hold the indicating device 30. The pocket 17 may have a recess structure formed by an inwardly recessed portion of the outer wall of the body 10.

Although the pocket 17 is provided at the outer wall of the body 10 in the form of a recess, this is merely an example. The pocket 17 may have various structures. For example, the pocket 17 may have a structure protruded from the outer wall of the body 10 or may have a drawer structure slidable into the body 10.

As shown in FIG. 2, a holder 19 may be provided at the pocket 17 to hold the indicating device 30. The holder 19 may be made of an elastic material, and may be coupled to an inner wall 23 of the pocket 17.

When the indicating device 30 is pressed against an inner surface 25 of the holder 19, an entrance 24 of the holder 19 is laterally widened to allow the indicating device 30 to be inserted into the holder 19. Thus, the indicating device 30 is firmly held by an elastic force of the holder 19. Of course, the holder 19 may also have various shapes and structures different from those of the above-described case, so long as the holder 19 satisfies the purpose of holding the indicating device 30 on the body 10.

Meanwhile, the body 10 may be provided, at the outer wall thereof, with an operating unit 40 which includes the selection buttons of the kind data input unit 26, the selection buttons of the state data input unit 15, and a display pane of the display 21.

Figure 4:
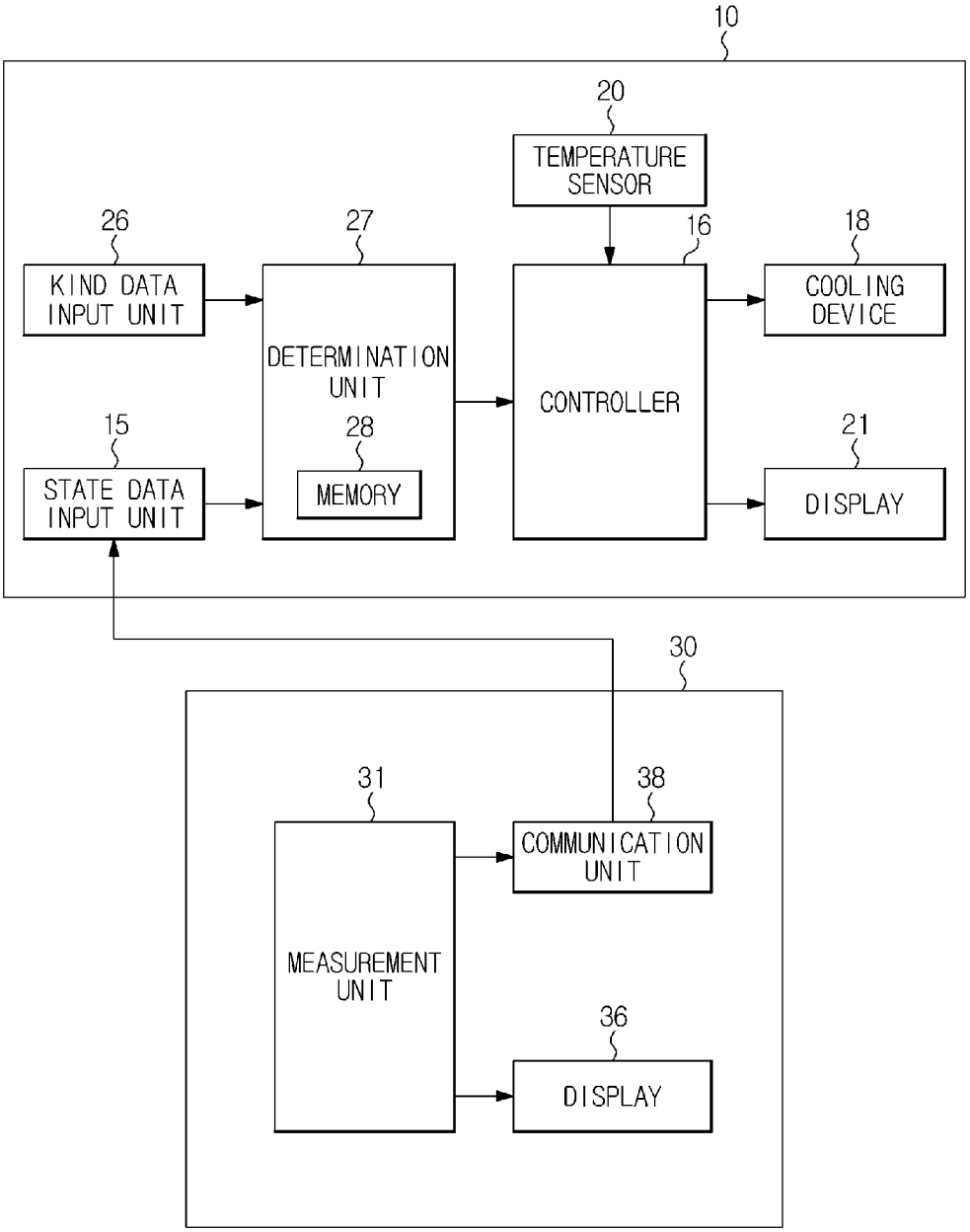
FIG. 4 is a block diagram for explaining a method for controlling the refrigerator according to the embodiment of FIG. 2.

FIG. 4 is a block diagram for explaining a method for controlling the refrigerator according to the embodiment of FIG. 2. Hereinafter, the refrigerator according to the embodiment of FIG. 2 and the control method thereof will be described with reference to FIGS. 2 and 4. The same constituent elements as those of the previous embodiment will be designated by the same reference numerals as those of the previous embodiment, and no description thereof will be given.

The indicating device 30 may include a measurement unit 31 to measure the state of food, and thus to obtain data about the measured food state, a display 36 to display the food state data obtained from the measurement unit 31, and a communication unit 38 to transmit the food state data obtained from the measurement unit 31 to the state data input unit 15 of the body 10 in a wired or wireless manner.

As shown in FIG. 2, the communication unit 38 is electrically connected to the state data input unit 15 as transmission terminals 53 of the communication unit 38 contact reception terminals 52 of the state data input unit 15. In this state, the communication unit 38 may communicate with the state data input unit 15 in a wired manner.

Also, the communication unit 38 may be connected with the state data input unit 15 in a wireless manner through a local area network such as Bluetooth or infrared communication such as radio frequency identification (RFID) or wireless internet such as Wi-Fi.

Accordingly, it may be possible to transmit the food state data displayed on the display 36 of the indicating device 30 in a wired or wireless manner without direct input of the food state data to the state data input unit 15 of the body 10 in a manual manner by the user. Thus, the display 36 of the indicating device 30 may be dispensed with.

Figure 5:
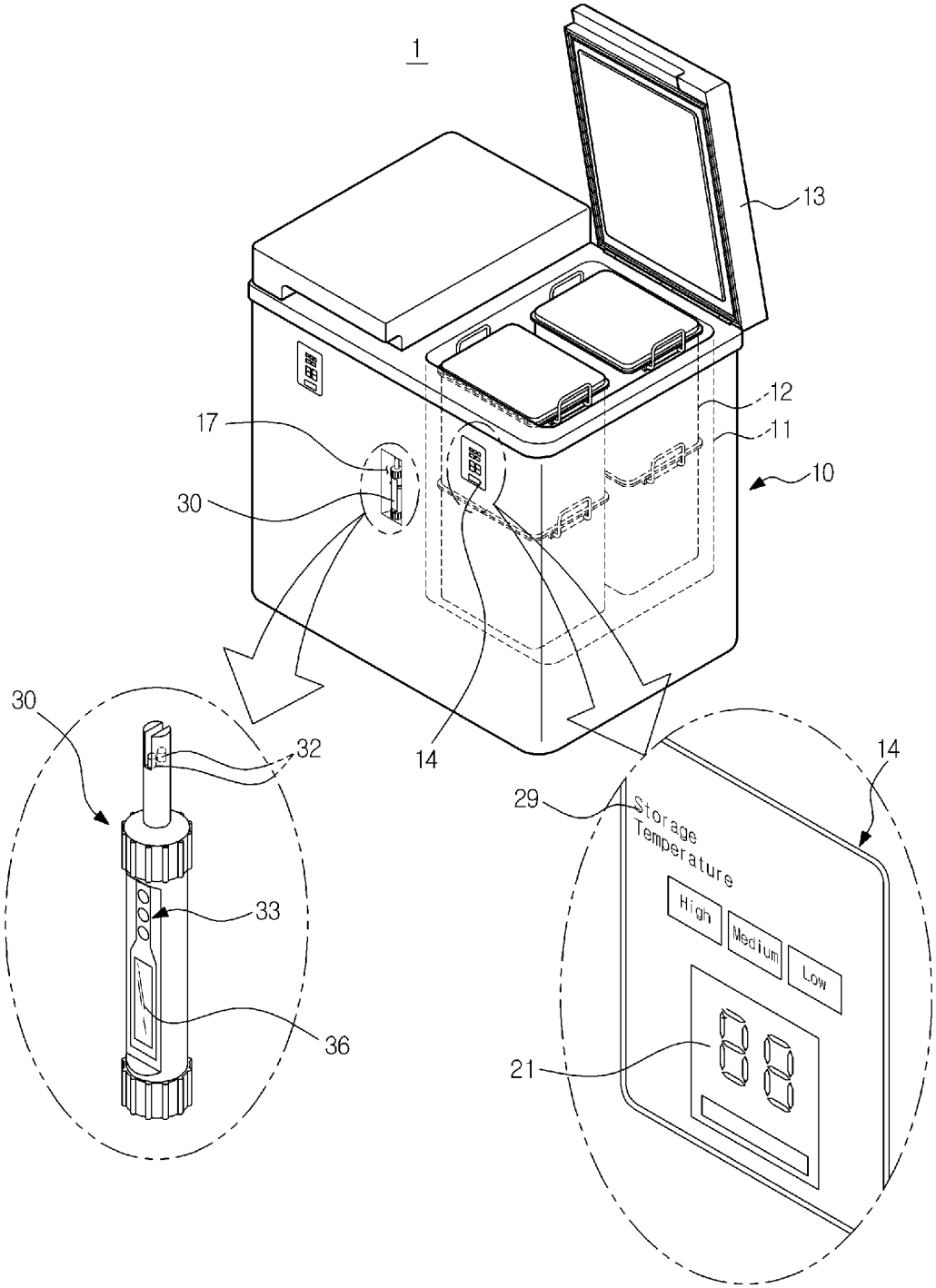
FIG. 5 is a perspective view illustrating outer appearances of a refrigerator according to another embodiment of the present invention and an indicating device thereof.
Figure 6:
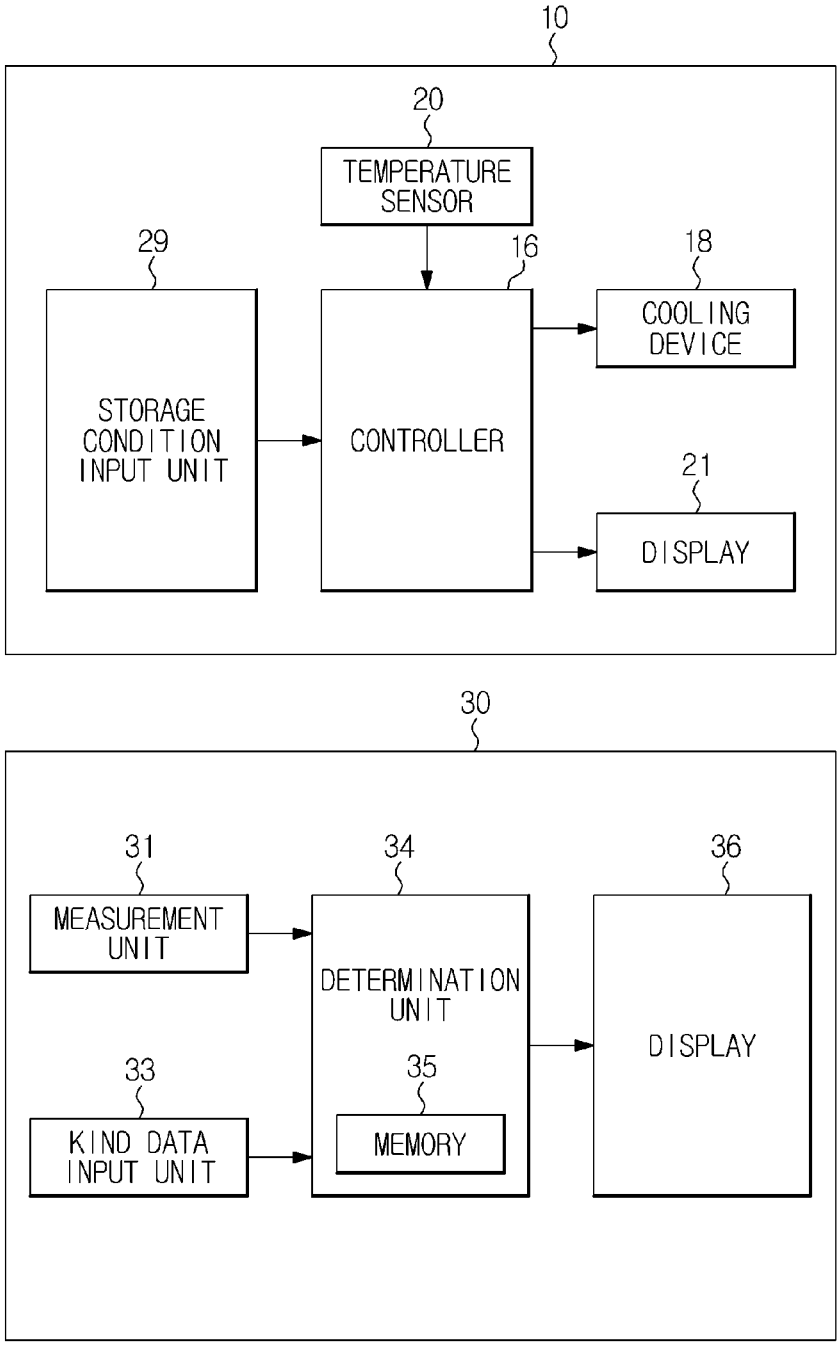
FIG. 6 is a block diagram for explaining a method for controlling the refrigerator according to the embodiment of FIG. 5.

FIG. 5 is a perspective view illustrating outer appearances of a refrigerator according to another embodiment of the present invention and an indicating device thereof. FIG. 6 is a block diagram for explaining a method for controlling the refrigerator according to the embodiment of FIG. 5. Hereinafter, the refrigerator according to the embodiment of FIG. 5 and the control method thereof will be described with reference to FIGS. 5 and 6. The same constituent elements as those of the previous embodiments will be designated by the same reference numerals as those of the previous embodiments, and no description thereof will be given.

The body 10 of the refrigerator 1 may include a storage condition input unit 29 to input a food storage condition such as a storage temperature, etc. according to the kind and state of food, and a controller 16 to control driving of the cooling device 18 in accordance with the food storage condition input through the storage condition input unit 29.

The storage condition input unit 29 may include a plurality of selection buttons respectively corresponding to different storage temperatures. FIG. 5 illustrates selection buttons respectively corresponding to high, medium, and low storage temperature ranges.

The indicating device 30 may include a measurement unit 31 to measure various states of food, and thus to obtain data about the measured food states, a kind data input unit 33 to directly receive data about the kind of food from the user, a determination unit 34 to determine a desired food storage condition based on the food state data obtained by the measurement unit 31 and the food kind data input through the kind data input unit 33, and a display 36 to display the food storage condition determined through the determination unit 34.

The determination unit 34 includes a memory 35 in which various food storage conditions according to various food states and various food kinds are pre-stored. Thus, the determination unit 34 may search the memory 35, to determine a food storage condition according to the food state data and food kind data.

In accordance with the above-described configuration, the indicating device 30 of FIGS. 5 and 6 may obtain data about various states of food and receive data about the kind of food. Furthermore, it may be possible to determine a desired food storage condition based on the food state data and food kind data.

Since the determined food storage condition is displayed through the display 36, the user may directly input the displayed food storage condition to the storage condition input unit 29 of the body 10.

Figure 7:
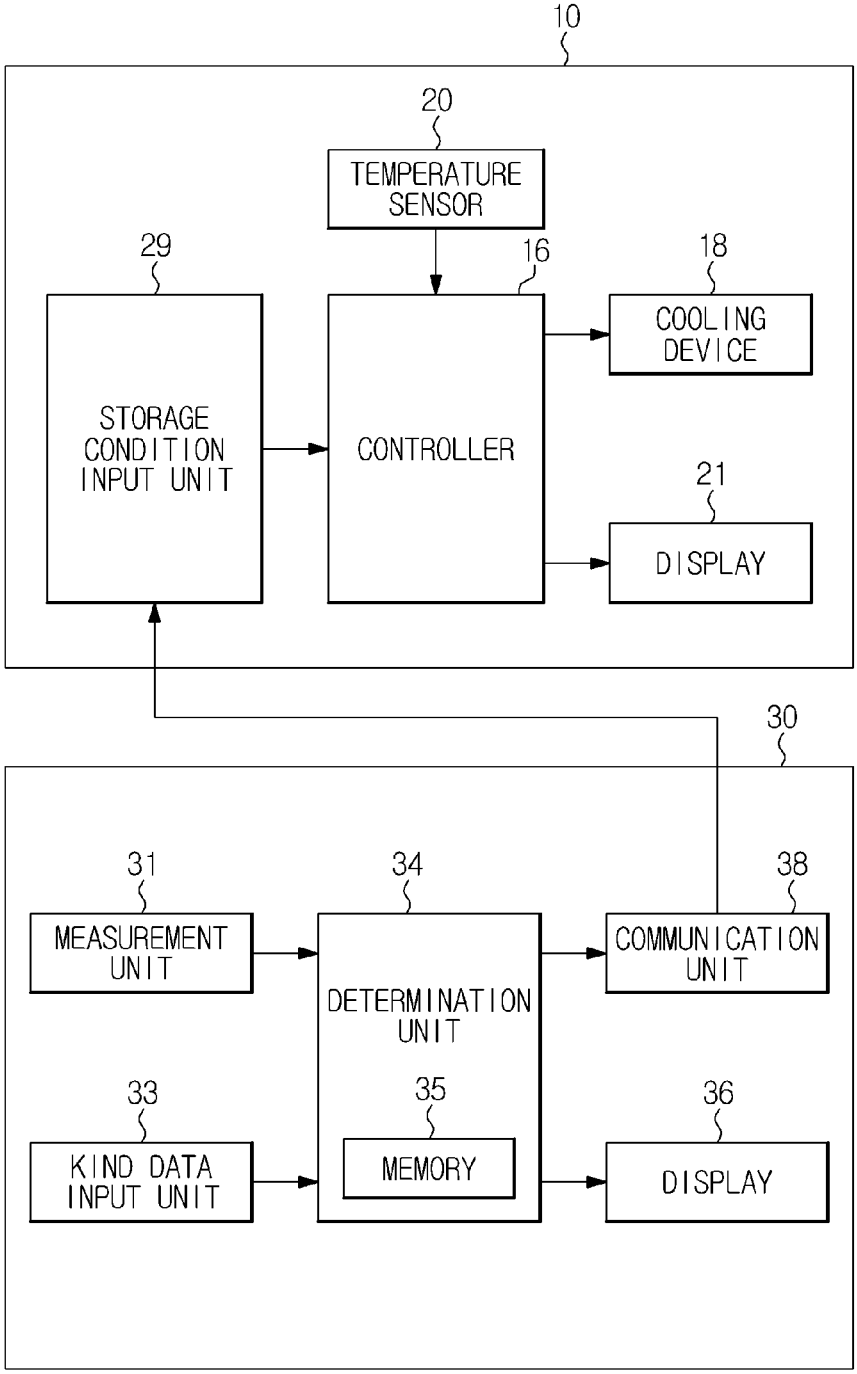
FIG. 7 is a block diagram for explaining a method for controlling the refrigerator according to another embodiment of the present invention.

FIG. 7 is a block diagram for explaining a method for controlling the refrigerator according to another embodiment of the present invention. Hereinafter, the refrigerator according to the embodiment of FIG. 7 and the control method thereof will be described with reference to FIG. 7. The same constituent elements as those of the previous embodiments will be designated by the same reference numerals as those of the previous embodiments, and no description thereof will be given.

The indicating device 30 may include a measurement unit 31, a kind data input unit 33, a determination unit 34, a display 36, and a communication unit 38.

The communication unit 38 may transmit, to the storage condition input unit 29 of the body 10, data about a food storage condition, such as food storage temperature, determined by the determination unit 34. The communication unit 38 may be connected to the storage condition input unit 29 through wired or wireless communication.

In accordance with the above-described configuration, the user may measure the state of food, using the indicating device 30, to obtain food state data. When the user then inputs data about the kind of food to the indicating device 30, the indicating device 30 determines a desired food storage condition. Data about the determined food storage condition may be transmitted to the body 10 through wired or wireless communication.

Meanwhile, in the refrigerator according to each of the above-described embodiments, the storage condition of food is determined, taking into consideration both the kind and stage of food. However, where the kind of food to be stored is previously determined, it may be possible to determine the food storage condition, taking into consideration only the state of food.

In this case, the kind data input unit 26 of the body 10 to receive data about the kind of food and the kind data input unit 33 of the indicating device 30 may be dispensed with. Also, the determination unit 27 of the body 10 and the determination unit 34 of the indicating device 30 may be configured to determine a desired food storage condition, only based on data about the state of food.

In accordance with each aspect, the indicating device, which is provided separately from the body, contacts food to measure the state of the food, only when measurement is required. Accordingly, it may be possible to solve a hygiene problem occurring when measurement terminals are in contact with food for a long period of time.

Also, it may be possible to measure the store of food stored in each storage container, using a single indicating device, and thus to reduce cost, as compared to the conventional refrigerator in which measurement terminals are provided at each storage container.

In addition, the user may directly measure the state of food stored in the refrigerator, to enable the refrigerator to determine a desired storage condition of the food, based on the result of the measurement. Thus, it may be possible to ensure reliability of the determined storage condition.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body having a storage chamber configured to store food;

a cooling device configured to supply cold air to the storage chamber;

an input unit configured to receive data about a state of the food stored in the storage chamber;

a determination unit configured to determine a desired storage condition for the food stored in the storage chamber, based on food state data input through the input unit;

a controller configured to control a driving of the cooling device based on the desired storage condition determined by the determination unit;

an indicating device provided to be portable, separately from the body, the indicating device comprising a measurement unit configured to measure the state of the food stored in the storage chamber, and to obtain the food state data, and a display configured to display the food state data obtained by the measurement unit; and a pocket on an outer wall of the body and configured to hold the portable indicating device;

wherein the determination unit is configured to determine the desired storage condition for the food stored in the storage chamber based on food state data that is manually input to the input unit after being obtained by the indicating device, and wherein the controller is configured to drive the cooling device based on the determined desired food storage condition.

2. The refrigerator according to claim 1, wherein the food state data comprises at least one of a salinity of the food, an acidity of the food, a temperature of the food, and a number of bacteria present in the food.

3. The refrigerator according to claim 1, wherein the measurement unit of the indicating device comprises at least one of a salinity measurer, an acidity measurer, a temperature measurer, and a bacteria number measurer, to obtain the food state data.

4. The refrigerator according to claim 1, wherein the determination unit comprises a memory in which data about various food storage conditions according to data about various food states is pre-stored.

5. The refrigerator according to claim 1, wherein the input unit is able to manually receive the food state data.

6. The refrigerator according to claim 1, wherein the input unit is able to receive the food state data from the indicating device through wired or wireless communication.

7. The refrigerator according to claim 6, wherein the indicating device further comprises a communication unit for the wired or wireless communication.

8. The refrigerator according to claim 7, wherein the input unit and the communication unit of the indicating device comprise connection terminals configured to come into contact with each other for electrical connection thereof, respectively.

9. The refrigerator according to claim 1, further comprising:

a kind input unit to receive data about the kind of the food, wherein the determination unit is configured to determine the desired storage condition for the food, based on the food state data input through the input unit and the food kind data input through the kind input unit.

10. The refrigerator according to claim 9, wherein the kind input unit selectively receives the kind input data.

11. The refrigerator according to claim 9, wherein the determination unit comprises a memory in which data about various food storage conditions according to data about various food states and data about various food kinds is pre-stored.

12. The refrigerator according to claim 1, wherein the food storage condition comprises a food storage temperature.

13. A refrigerator comprising:

a body having a storage chamber configured to store food;

a cooling device configured to supply cold air to the storage chamber;

an input unit configured to receive data about a state of the food stored in the storage chamber;

a determination unit configured to determine a desired storage condition for the food stored in the storage chamber based on food state data input through the input unit;

a controller configured to control a driving of the cooling device based on the storage condition determined by the determination unit;

an indicating device provided to be portable, separately from the body, the indicating device comprising a measurement unit configured to measure the state of the food stored in the storage chamber, and to obtain the food state data, a communication unit configured to transmit the food state data obtained through the measurement unit to the input unit through wired or wireless communication, and a display configured to display the food state data obtained through the measurement unit; and a pocket on an outer wall of the body and configured to hold the portable indicating device;

wherein the determination unit is configured to determine the desired storage condition for the food stored in the storage chamber based on food state data that is input through wired or wireless communication after being obtained by the indicating device, and wherein the controller drives the cooling device based on the determined desired food storage condition.

14. A refrigerator comprising:

a body having a storage chamber to store food;

a cooling device to supply cold air to the storage chamber;

a storage condition input unit provided at the body, to receive a desired storage condition for the food;

a controller provided at the body, to control driving of the cooling device, based on the desired storage condition input through the storage condition input unit; and an indicating device provided to be portable, separately from the body, the indicating device comprising a measurement unit to measure a state of the food, and thus to obtain data about the measured food state, a determination unit to determine the food storage condition, based on the food state data obtained through the measurement unit of the indicating device, and a display to display the food state condition determined through the measurement unit of the indicating device, wherein the desired storage condition for the food is determined by the indicating device based upon the food state data obtained by the indicating device, and wherein the storage condition input unit is configured to receive as a manual input the desired storage condition for the food determined by the indicating device, and wherein the determination unit of the indicating device comprises a memory in which data about various food storage conditions according to data about various food states is pre-stored.

15. The refrigerator according to claim 14, wherein the storage condition input unit is able to manually receive the food storage condition.

16. The refrigerator according to claim 14, wherein the storage condition input unit is able to receive the food storage condition from the indicating device through wired or wireless communication.

17. The refrigerator according to claim 16, wherein the indicating device further comprises a communication unit for the wired or wireless communication.

18. The refrigerator according to claim 14, wherein:

the indicating device further comprises a kind input unit to receive data about a kind of the food; and the determination unit of the indicating device determines the food storage condition, based on the food state data obtained through the measurement unit of the indicating device and the food kind data input through the kind input unit of the indicating device.

19. The refrigerator according to claim 18, wherein the kind input unit of the indicating device selectively receives the kind input data.

20. The refrigerator according to claim 18, wherein the determination unit of the indicating device comprises a memory in which data about various food storage conditions according to data about various food states and data about various food kinds is pre-stored.

21. A refrigerator comprising:

a body having a storage chamber to store food;

a cooling device to supply cold air to the storage chamber;

a storage condition input unit provided at the body, to receive a storage condition for the food;

a controller provided at the body, to control driving of the cooling device, based on the storage condition input through the storage condition input unit; and an indicating device provided to be portable, separately from the body, the indicating device comprising a measurement unit to measure a state of the food, and thus to obtain data about the measured food state, a determination unit to determine the food storage condition, based on the food state data obtained through the measurement unit of the indicating device, a communication unit to transmit the food storage condition determined through the determination unit of the indicating device to the storage condition input unit of the body through wired or wireless communication, and a display to display the food state data obtained through the measurement unit, wherein, when the food state data is obtained by the indicating device, the food storage condition is determined by the indicating device, and the determined food storage condition is then input to the body through wired or wireless communication, and the controller is configured to control the driving of the cooling device based on the determined food storage condition.

22. A refrigerator comprising:

a body having a storage chamber configured to store food;

a cooling device configured to supply cold air to the storage chamber;

an indicating device provided to be portable, separately from the body, the indicating device comprising a measurement unit configured to measure a state of the food stored in the storage chamber, and to obtain data about the measured food state, and a display configured to display the food state data obtained by the measurement unit;

a pocket on an outer wall of the body and configured to hold the portable indicating device; and a determination unit, provided at the body, to determine a desired storage condition for the food, based on input food state data, wherein the determination unit is configured to determine the desired storage condition for the food based on the obtained food state data, and wherein the controller is configured to drive the cooling device based on the determined desired food storage condition.

* * * * *